US005207821A

United States Patent [19]

Ikenoue et al.

[11] Patent Number: 5,207,821

[45] Date of Patent: May 4, 1993

[54] MULTI-PHASE SINTERED ALLOY COMPOSITION AND METHOD OF MANUFACTURING THE SAME

[75] Inventors: Yutaka Ikenoue; Keitaro Suzuki; Yoshimasa Aoki, all of Chiba; Hideo Urata, Saitama; Koji Koishikawa, Kanagawa; Makoto Tsuji, Saitama, all of Japan

[73] Assignees: Hitachi Powdered Metals Co., Ltd., Chiba; Honda Giken Kogyo Kabushiki Kaisha, Tokyo, both of Japan

[21] Appl. No.: 727,601

[22] Filed: Jul. 9, 1991

[30] Foreign Application Priority Data

Jul. 12, 1990 [JP] Japan ..... 2-182767

[51] Int. Cl.[5] ..... C22C 9/00

[52] U.S. Cl. ..... 75/247; 419/6; 419/23; 419/26; 419/39; 419/60

[58] Field of Search ..... 75/246, 247; 419/6, 419/23, 26, 39, 60; 420/436, 489, 490, 495, 496

[56] References Cited

U.S. PATENT DOCUMENTS

| | | | |
|---|---|---|---|
| Re. 28,552 | 9/1975 | Smith | 148/32 |
| 4,285,739 | 8/1981 | Deruyttere et al. | 148/11.15 C |
| 4,365,996 | 12/1982 | Melton et al. | 419/28 |
| 4,372,783 | 2/1983 | Kato | 75/246 |
| 4,518,444 | 5/1985 | Albrecht et al. | 148/402 |
| 4,935,056 | 6/1990 | Miyasaka et al. | 75/231 |
| 5,049,183 | 9/1991 | Saka et al. | 75/244 |

*Primary Examiner*—Donald P. Walsh
*Assistant Examiner*—Ngoclan T. Mai
*Attorney, Agent, or Firm*—Sandler, Greenblum & Berstein

[57] ABSTRACT

Disclosed is a sintered alloy composition and method of manufacturing the same, the sintered alloy composition having a multi7phase structure, comprising: a first phase composed of aluminum and copper; and a second phase being dispersed in the first phase and composed of molybdenum, chromium, silicon and cobalt. This alloy composition has excellent abrasion and corrosion resistance, preferably to be used for making machine parts such as valve seats for engines.

28 Claims, 2 Drawing Sheets

MULTI-PHASE SINTERED ALLOY COMPOSITION AND METHOD OF MANUFACTURING THE SAME

BACKGROUND OF THE INVENTION

1. Field of the Invention

The present invention relates to a sintered alloy composition and a manufacturing method thereof, and more particularly to a sintered alloy composition having excellent abrasion and corrosion resistance, preferably to be used for making machine parts such as valve seats for engines.

2. Description of the Prior Art

Most machine parts such as valve seats for internal combustion engines are required to have mechanical strength and resistance. For example, in the case of a valve seat of an internal combustion engine, a valve reciprocates at high speed and experiences slight pivotal motion during engine operation, and the valve seat receives the reciprocating valve on its seat surface. Consequently, the valve seat suffers continuous impacts from the valve while being exposed to hot combustion gas produced in the engine cylinder. Therefore, it is of course important for the valve seat of the engine to have abrasion resistance. Moreover, with regards to structure, the valve seat is fitted to the cylinder head of the engine only by inserting it with pressure into a fitting hole in the cylinder head. According to this structure, if the valve seat has poor radial crushing strength, trouble can arise that will cause the valve seat to get loose and fall out of the fitting hole. In view of the above, it is also important for the valve seat of the engine to have sufficient hardness and strength (radial crushing strength).

In internal combustion engines for motorcars, valve seats had at first been manufactured by using cast iron alloy. At present, they are manufactured with sintered iron alloys. However, such iron alloy are not suitable for machine parts such as a valve seats for outboard engines for marine vessels, because those machine parts are utilized in highly corrosive environments where they are in contact with sea water and dew arising in salty air.

For this reason, in the manufacturing of outboard engines, aluminum bronze has conventionally been employed as a material for the valve seat. However, in accordance with recent trends for a high-power outboard engines, structural parts of outboard engines need to have vastly improved mechanical properties. Accordingly, the material for valve seats also has to have better mechanical properties such as abrasion and corrosion resistance.

SUMMARY OF THE INVENTION

It is, therefore, an object of the present invention to provide a sintered alloy which can be employed for manufacturing machine parts having sufficient strength, abrasion resistance, and durability against continuous impacts caused by valve motion.

In accordance with the present invention, there is provided a sintered alloy composition having a multiphase structure, comprising: a first phase including aluminum and copper; and a second phase being dispersed in the first phase and including molybdenum, chromium, silicon and cobalt.

The sintered alloy composition of the present invention is particularly suitable as a material for manufacturing machine parts such as valve seats for outboard engines for marine vessels, because the composition has improved abrasion resistance and durability against continuous impacts.

The machine part made of the sintered alloy composition according to the present invention is manufactured by a method comprising steps of: (a) mixing copper powder and alloy powder having a composition of about 48% to about 52% aluminum by weight and balance copper so that the mixed powder has the same composition as that of the first phase; (b) further mixing the mixed powder obtained in step (a) with alloy powder containing molybdenum, chromium, silicon and cobalt with the same composition as that of the second phase; (c) compacting the mixed powder obtained in step (b) by compression to form a compact for a machine part; and (d) sintering the compact obtained in step (c). The manufacturing method can preferably comprise further a step of (e) oxidizing the sintered alloy compact.

BRIEF DESCRIPTION OF THE DRAWINGS

FIG. 3 also shows the relationship of radial crushing strength in the case of particle sizes of less than that classified as 100 mesh with respect to hard dispersion phase content in a sintered alloy composition.

DETAILED DESCRIPTION OF THE PREFERRED EMBODIMENTS

Figure 1:
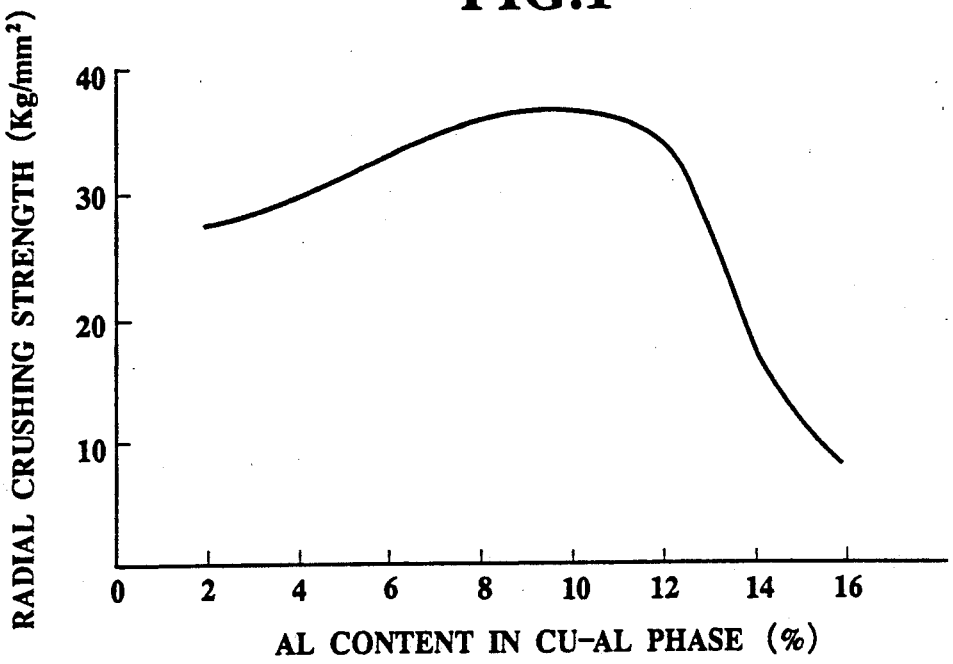
FIG. 1 is a graph showing the relationship of radial crushing strength with respect to aluminum content in base phase of a sintered alloy composition according to the present invention.

The sintered alloy according to the present invention has been achieved by the present inventors through vigorous research into improving aluminum bronze alloys. As is well-known, aluminum bronze is composed of aluminum and copper, and the present invention involves a sintered alloy composed of aluminum, molybdenum, chromium, silicon, cobalt and copper, which is characterized by having a metallographic structure in which the aluminum bronze base phase is dispersed with a particular hard phase composed of molybdenum, chromium, silicon and cobalt.

Preferably, the sintered alloy according to the present invention is composed of 5.8% to 10.6% aluminum by weight, 3.3% to 5% molybdenum by weight, 0.9% to 1.6% chromium by weight, 0.3% to 0.5% of silicon by weight, 7% to 10.7% cobalt by weight, and the balance copper; and the alloy comprises a base phase composed of 7% to 12% aluminum by weight and balance copper, and a hard dispersion phase composed of 27% to 30% molybdenum by weight, 7.5% to 9.5% chromium by weight, 2.1% to 2.7% of silicon by weight, and balance cobalt.

The above-described sintered alloy according to the present invention is manufactured by the method of powder metallurgy. This is because the method of powder metallurgy has advantages in that various additive components can be uniformely dispersed into the base material. Furthermore, even in the case when the manufactured sintered alloy is to have the same composition as that of a known alloy, it is possible to impart a novel or improved property to the sintered alloy by utilizing a different manufacturing process and using raw material having the same composition but prepared by different methods.

The process of manufacturing the sintered alloy according to the present invention comprises the steps of mixing raw material powder for the base phase with that for the hard dispersion phase, compacting the mixed powder to form a compact with a predetermined shape, and sintering the compact, characterized in that, at the mixing step, simple copper powder is mixed with copper alloy powder preferably containing 48% to 52% of aluminum by weight so as to form a material for the base phase composed of 7% to 12% aluminum by weight and balance copper. It should be noted that it is not sufficient to use a powder prepared from ingots having the same composition as that of the base phase obtained by the method described above. This method is used for the two purposes discussed below.

The first purpose for employing the above characterized mixing step is to prevent deterioration of the powder flow characteristics of the mixed powder, because such deterioration leads to a reduction in the operational efficiency in compacting the mixed powder and a decrease in the density of compressed compact. Alloy powder composed of copper and aluminum has poor flow characteristics in itself, hence the compact therefrom is poor in compressibility. For example, the compressibility of the compact using only alloy powder composed of 10% aluminum by weight and balance copper is about 5.3 to 5.4 g/cm$^3$. In contrast with this, for a compact using a mixed powder of copper simple powder and alloy powder composed of half aluminum and half copper by weight with control of the total composition to the same 10% by weight, the compressibility reaches 5.8 to 5.9 g/cm$^3$, and the mixed powder has good flow characteristics because the ratio of the copper-aluminum alloy powder to the overall mixed powder is only 20% by weight.

The second purpose of the above characterized mixing step is increased safety and ease of the manufacturing process. When copper-aluminum alloy powder containing a large amount of aluminum is manufactured by the method of atomization, the atomized metal is easily oxidized. Accordingly, the copper aluminum alloy powder is generally prepared by the method of pulverization in which an alloy ingot having a desired composition is pulverized to obtain an alloy powder. However, the pulverization method has a defect in that high aluminum-content alloys containing more than 60% aluminum by weight easily catch fire during pulverization, while low aluminum-content alloys containing less than 40% aluminum by weight are too soft to be subjected to pulverization. In sum, the preparation of alloy powder comprising 50±2% aluminum by weight is arranged in view of safety in manufacturing the alloy powder, ease in handling the mixed alloy powder, and further in view of allowability in terms of quality control of products.

Moreover, at the mixing step of the manufacturing process, powder composed of 27% to 30% molybdenum by weight, 7.5% to 9.5% chromium by weight, 2.1% to 2.7% silicon by weight and the balance cobalt is preferably used as the raw material powder for the hard dispersion phase in the sintered alloy. The composition of the raw material powder corresponds to the composition of the hard dispersion phase, accordingly. This alloy powder is mixed with the above-mentioned simple copper powder and the copper-aluminum alloy powder so as to meet the composition of the sintered alloy according to the present invention. Alloy powder having the above-mentioned composition is on sale under the trade name COBAMET, from Fukuda Metal Foil & Powder Co., Ltd., and such powder can be used preferably as the raw material powder for the hard dispersion phase. This alloy powder for the hard dispersion phase preferably has a particle classification of equal to or more than 350 mesh. Here, in the present invention, particle sizes of powder are defined by sieve classification with a mesh sizes unit ("mesh" in Japanese Industrial Standard). Namely, powder of 100 mesh is equal to a minus sieve passing through a sieve having a mesh size of 149 μm, powder of 200 mesh is that of 74 μm, and 350 mesh is that of 44 μm.

At the sintering step, highly-purified hydrogen gas having a high dew point can be used as a sintering atmosphere, but vacuum sintering is preferable because of safety and ease of practical use in industrial manufacturing processes. With regards to sintering temperature, it is known that, an alloy composed of 10% aluminum by weight and balance copper, the composition corresponding to that of the base phase in the sintered alloy according to the present invention, has stable phase structure at a temperature of 990° C., and melts at a temperature of more than 1,020° C. Therefore, a sintering temperature of 990° C. is the most prefered for the present invention, and it is best not to exceed this temperature.

Below, relationships between the composition and mechanical properties of the sintered alloy according to the present invention will be described in detail in accordance with examples and some comparative examples.

Sintered alloy samples for each example were prepared in accordance with the compositions shown in Table 1, which also shows the raw material powder employed for each example, composition and mixing rate of the raw material powder, composition of the sintered product to be obtained, and material properties of the each product. In Table 1, sample No. 20 is a comparative sample in which the hard dispersion phase is omitted from the sintered alloy composition of the present invention, and sample No. 21 is another comparative sample of a conventional aluminum bronze ingot material. Moreover, in Table 1, Cu-Al powder L indicates powder composed of 48% aluminum by weight and balance copper; Cu-Al powder M is that composed of 50% aluminum by weight and balance copper; and Cu-Al powder H is that composed of 52% aluminum by weight and balance copper. With regards to the powder for the dispersion phase, powder l indicates powder composed of 27% molybdenum by weight, 7.5% chromium by weight, 2.1% silicon by weight and the balance cobalt; powder m is that composed of 28% molybdenum by weight, 8.5% chromium by weight, 2.4% silicon by weight and the balance cobalt; and powder h is that composed of 30% molybdenum by weight, 9.5% chromium by weight, 2.7% silicon by weight and the balance cobalt. Each of the powders l, m, h for the hard dispersion phase was prepared so as to have particle size equal to or less than that classified as 350 mesh.

Sample Nos. 1 through 20 in Table 1 were prepared by the same manufacturing method. By way of example of the manufacturing process of the sintered alloy samples, the manufacturing process of sample 5 will be described in detail.

First, one part Cu-Al alloy powder M by weight was mixed with four parts copper powder by weight. The mixed powder has 10% aluminum content by weight accordingly, and this powder forms the base phase. Second, one hundred parts of the obtained mixed powder by weight was combined and mixed with seventeen parts by weight of the powder m for the hard dispersion phase, the powder m being composed of 28% molybdenum by weight, 8.5% chromium by weight, 2.4% silicon by weight and the balance cobalt, which is to form the hard dispersion phase in the sintered alloy by itself. Accordingly, the content of the hard dispersion phase in the sintered alloy sample No. 5 can be introduced by calculation of 17/(100+17) to be 14.5% by weight. Third, the mixed powder was combined with 0.5% ethylene bisstearamide (as a lubricant) by weight. Finally, the mixed powder was formed into a compact having a predetermined form for a seat valve and sintered at a temperature of 990° C. for 60 min in a vacuum sintering furnace.

Each sintered alloy sample obtained by the above-described manufacturing method is an annular piece having an inner bore of 20 mm, an outer bore of 40 mm and a thickness of 10 mm. The samples were measured for radial crushing strength by means of an Amsler type universal tester, the results of which are shown in Table 2.

Sample Nos. 1 through 8 in Tables 1 and 2 have the same hard dispersion phase content, but have a different aluminum content in the base phase. Thus, from the results of these examples, the relationship between the radial crushing strength and the aluminum content in the base phase of the sintered alloy is illustrated in FIG. 1.

As shown in FIG. 1, the radial crushing strength of the sintered alloy increases gradually as the aluminum content increases, and reaches a maximun value at 10% aluminum content by weight, but decreases drastically at more than 12% aluminum content by weight. Therefore, the suitable aluminum content in the base phase is preferably in the range of 7% to 12% by weight, with the most prefered content being about 10% by weight. In any case, within that range the sintered alloy retains approximately 34 kg/mm$^2$ of radial crushing strength.

Next, samples No. 5 and 9 through 21 in Table 1, after undergoing the manufacturing process described hereinabove, were subjected to oxdization at a temperature of 400° C. for 120 min in an atmosphere of air. Then each sample was measured with respect to abrasion resistance. The testing machine used for obtaining such measurements was a simulated engine constructed of the essential parts of an actual engine. This testing machine has a mechanism in which a valve made of heat resistant steel SUH35 is combined with one of the sample valve seats. The mechanism is then heated to a predetermined temperature by means of LPG gas combustion, while a cam shaft of the simulated engine rotats by an electric motor to impact the valve against the valve seat. In this testing machine, every factor, such as temperature, engine speed, pressing force of the valve spring and the like, can be freely set at a desired level in order to subject the samples to various severe tests. Using this testing machine, sample Nos. 5 and 9 through 21 were measured for abrasion loss after being subjected to a condition of 250° C. at an engine speed of 1,500 rpm for 30 continuous hours. The results of that test are shown in Table 2.

Figure 2:
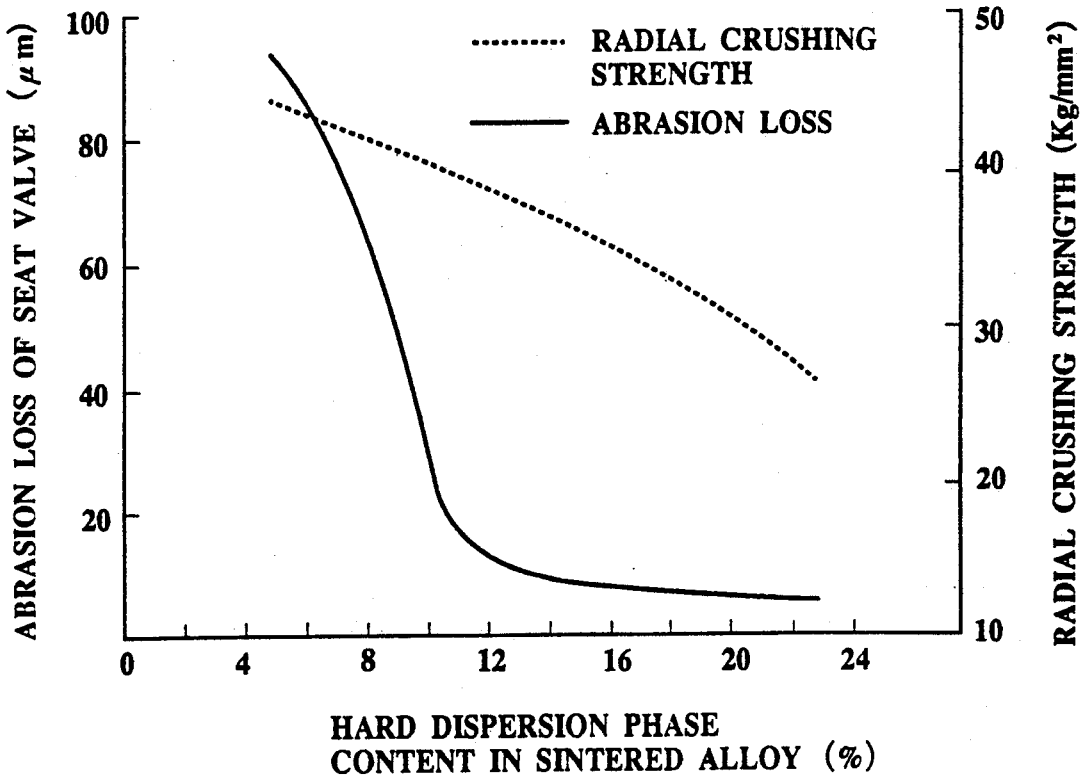
FIG. 2 is a graph showing the relationships of abrasion loss and radial crushing strength with respect to hard dispersion phase content in a sintered alloy composition according to the present invention.

Sample Nos. 5 and 9 through 15 have the same base phase content described hereinabove as being the most prefered, but differ in content of hard dispersion phase in the sintered alloy. Accordingly, by comparing the results of these examples, relationships of the radial crushing strength and abrasion resistance with respect to the content of the hard dispersion phase in the sintered alloy can be ascertained. These relationships are illustrated in FIG. 2.

As is clearly shown in FIG. 2, as the hard dispersion phase content increases, the abrasion loss of the seat valve sample decreases drastically at first and then somewhat gradually at more than 10% dispersion phase content, and later decreases to less than 15 μm at 12% dispersion phase content. After 12% content, the decrease is very negligible. On the other hand, as the hard dispersion phase content increases, the radial crushing strength decreases at an almost constant slope at first and then somewhat steeply at more than 12% hard dispersion phase content by weight, and falls to less than 34 kg/mm$^2$ after the content exceeds 17% by weight.

From the above results, the amount of hard dispersion phase in the sintered alloy is considered preferably to be equal to or more than 12% by weight, the point after which the change in the abrasion loss is small. On the other hand, with regards to the radial crushing strength, the prefered content should be equal to or less than 17% by weight. As a result, the most prefered range of the hard dispersion phase content lies between 12% and 17% by weight.

The above mentioned sample Nos. 1 to 8 were prepared using the same raw material powder, namely the Cu-Al powder M and the powder m for hard dispersion phase, but with different mixing ratios. In comparison with these samples, each sample from No. 16 to 19 was prepared using different compositions of raw material powders so that the obtained alloy sample may contain aluminum and the hard dispersion phase component within the prefered range mentioned above. The results of these samples show that these embodiments also impart excellent mechanical properties to the sintered alloy within the scope of the present invention.

Moreover, the following was undertaken for the purpose of studying the effect of particle size of the powder for the hard dispersion phase on each of the mechanical properties. Each sample was prepared from raw material powder having different particle sizes of equal to or less than that classified as 100 mesh and of equal to or less than that classified as 200 mesh with the same composition as that of each of Nos. 9 to 19, and they were then measured for sintered density, radial crushing strength and abrasion loss. The results of those tests are shown in Table 3 together with those described hereinabove which were prepared from a powder having a particle size of equal to or less than that classified as 350 mesh. Based on these results, the relationship between the radial crushing strength and the content of the hard dispersion phase in the case of particle sizes of equal to or less than that classified as 100 mesh is shown in FIG.

3. Comparing FIG. 3 with FIG. 2, it is seen that, irrespective of the particle size of the powder for the hard dispersion phase, the radial crushing strength changes in almost the same manner. From FIG. 3 and Table 3, utilization of fine powder is considered to bring little improvement of the radial crushing strength and sintered density, though it tends to develop the degree of sintering.

Figure 3:
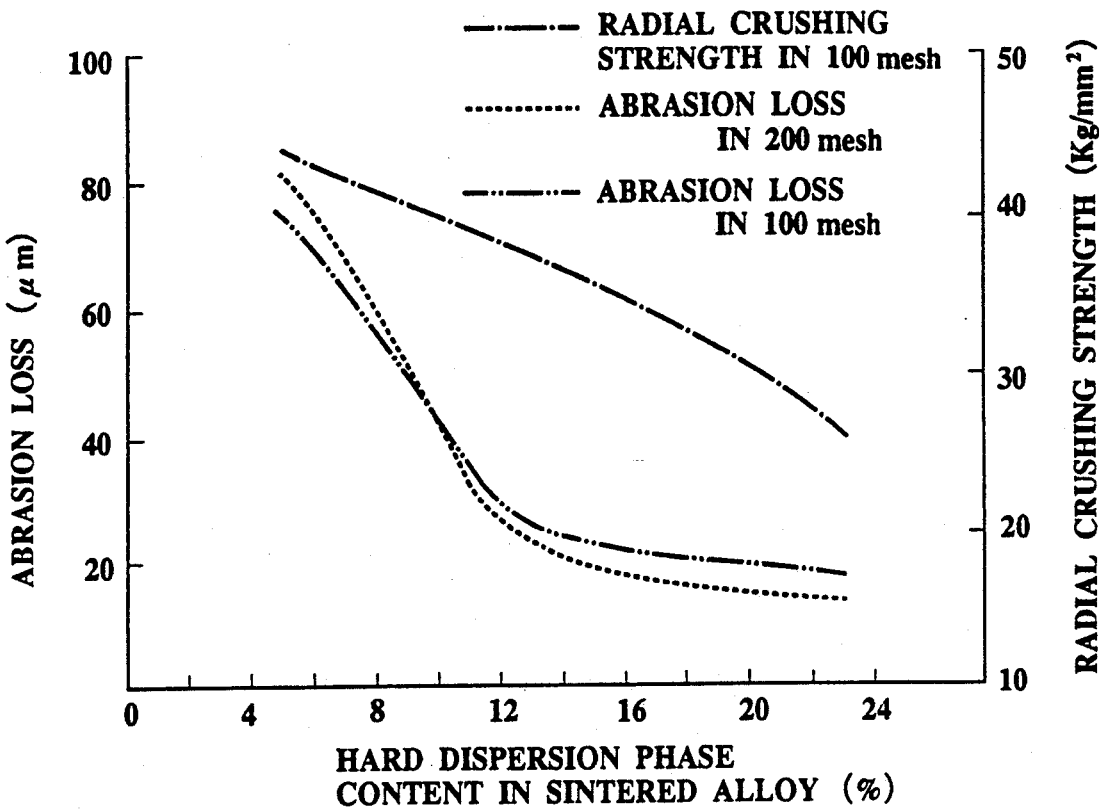
FIG. 3 is a graph showing the relationship of abrasion loss of a sintered alloy composition for the cases of particle sizes of equal to or less than that classified as 100 mesh and of equal to or less than that classified as 200 mesh.

On the other hand, FIG. 3 also shows the relationship between the abrasion loss and the hard dispersion phase content for the two cases of particle sizes of equal to or less than that classified as 100 mesh and equal to or less than that classified as 200 mesh in the powder for the hard dispersion phase. As seen from FIGS. 2 and 3, this relationship is clearly affected by the change in the particle size of the powder. Specifically, the abrasion loss, which decreases at the lower range of the hard dispersion phase content as the particle size of the powder for the hard dispersion phase increases, reaches almost the same value at about 9% hard dispersion phase content by weight irrespective of the particle size, and conversely at the range of more than 9%, it increases as the particle size increases. Namely, the relationship of the abrasion loss and the particle size reverses near the vicinity of 9% dispersion phase content. However, the common feature between the two cases of different particle size is that the decreasing rate of abrasion loss with respect to the hard dispersion phase content falls off, and the abrasion loss becomes stable at more than 12% hard dispersion phase content. In any case, within this range the abrasion loss is measured at less than 30 μm (which corresponds to 20% of the thickness of the sample), and this is considered to be sufficient for the requirements in question. Therefore, utilization of powder having particle sizes of equal to or less than that classified as 100 mesh for the dispersion phase will be sufficient enough for improvement of products for the present. Moreover, looking to the future, an abrasion loss of less than 16 μm (which corresponds to 10% of the thickness of the samples) will be desired, as this is expected to become a standard requirement in a few years hence. According to this, utilization of powder having particle sizes of equal to or less than that classified as 350 mesh is more prefered.

Finally, the effect of oxidization on the sintered alloy product will be described hereinbelow.

Figure 4:
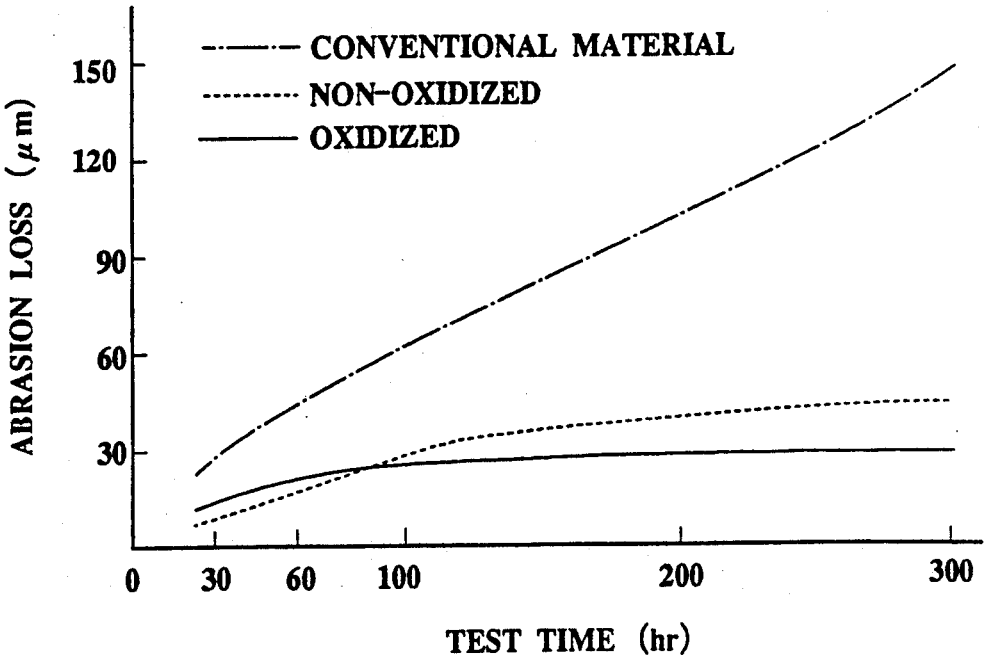
FIG. 4 is a graph showing the relationships of abrasion loss with respect to test time for oxidized and non-oxidized sintered alloy compositions according to the present invention compared with that of a conventional alloy product.

FIG. 4 is a graph showing the results of measurements of abrasion loss over time for the two cases of Sample No. 5 being oxidized and non-oxidized, respectively, after the sintering step, with data from the conventional material sample (aluminum bronze ingot sample). The measurement was performed by using an actual four-stroke type, water-cooled engine having a displacement of 280 cc.

FIG. 4 shows that the valve seat samples according to the present invention are distinctively excellent in abrasion resistance in comparison with the conventional material sample.

With regards to the effects of oxidization, the abrasion loss of the non-oxidized sample is initially less than that of the oxidized sample. However, after about 80 hrs, the former increases more than the latter to the point where the oxidized sample reaches a relatively constant state faster than the non-oxidized sample. As a result, the abrasion loss of the oxidized sample ends up being smaller than that of the non-oxidized sample. This seems so because even after losing the oxidized layer from the surface by abrasion or stripping, the oxidized sample still retains another oxidized layer in its pores. The pores are characteristic of the sintered alloy, whereby the strength of the alloy is reinforced to reduce abrasion. Consequently, in the case where the valve seat of an engine is subjected to severely abrasive conditions, an oxidized sintered alloy valve seat according to the present invention is preferable.

As there are many apparently widely different embodiments of the present invention that may be made without departing from the spirit and scope thereof, it is to be understood that the invention is not limited to the specific embodiments thereof except as defined in the appended claims.

TABLE 1

| Sample No. | Raw Material Powder Mixing Ratio (% by weight) Cu | Cu—Al Powder 1) | Powder for Dispersion Phase 2) | Composition of Sintered Alloy (% by weight) Al | Cr | Mo | Si | Co | Cu | Al Content in Base Phase (% by weight) | Dispersion Phase Ration to Base Phase (part by weight) | Sintered Density (g/cm³) | Hardness (HRB) |
|---|---|---|---|---|---|---|---|---|---|---|---|---|---|
| 1 | 82.1 | M 3.4 | m 14.5 | 1.7 | 1.2 | 4.1 | 0.4 | 8.9 | balance | 2 | 17 | 8.1 | 54 |
| 2 | 78.6 | M 6.9 | m 14.5 | 3.5 | 1.2 | 4.1 | 0.4 | 8.9 | balance | 4 | 17 | 7.5 | 55 |
| 3 | 75.2 | M 10.3 | m 14.5 | 5.2 | 1.2 | 4.1 | 0.4 | 8.9 | balance | 6 | 17 | 7.2 | 58 |
| 4 | 71.8 | M 13.7 | m 14.5 | 6.9 | 1.2 | 4.1 | 0.4 | 8.9 | balance | 8 | 17 | 7.0 | 60 |
| 5 | 68.3 | M 17.2 | m 14.5 | 8.6 | 1.2 | 4.1 | 0.4 | 8.9 | balance | 10 | 17 | 6.8 | 60 |
| 6 | 65 | M 20.5 | m 14.5 | 10.3 | 1.2 | 4.1 | 0.4 | 8.9 | balance | 12 | 17 | 6.6 | 61 |
| 7 | 61.6 | M 23.9 | m 14.5 | 12 | 1.2 | 4.1 | 0.4 | 8.9 | balance | 14 | 17 | 6.3 | 52 |
| 8 | 58.1 | M 27.4 | m 14.5 | 13.7 | 1.2 | 4.1 | 0.4 | 8.9 | balance | 16 | 17 | 6.1 | 48 |
| 9 | 76.2 | M 19 | m 4.8 | 9.5 | 0.4 | 1.3 | 0.1 | 2.9 | balance | 10 | 5 | 6.6 | 56 |
| 10 | 74.1 | M 18.5 | m 7.4 | 9.3 | 0.6 | 2.1 | 0.2 | 4.5 | balance | 10 | 8 | 6.7 | 58 |
| 11 | 72.1 | M 18.0 | m 9.9 | 9.0 | 0.8 | 2.8 | 0.2 | 6.0 | balance | 10 | 11 | 6.7 | 58 |
| 12 | 70.2 | M 17.5 | m 12.3 | 8.8 | 1.0 | 3.4 | 0.3 | 7.5 | balance | 10 | 14 | 6.7 | 58 |
| 5 | 68.3 | M 17.2 | m 14.5 | 8.6 | 1.2 | 4.1 | 0.4 | 8.9 | balance | 10 | 17 | 6.8 | 60 |
| 13 | 66.6 | M 16.7 | m 16.7 | 8.4 | 1.4 | 4.7 | 0.4 | 10.2 | balance | 10 | 20 | 6.8 | 62 |
| 14 | 64 | M 16 | m 20 | 8.0 | 1.7 | 5.6 | 0.5 | 12.2 | balance | 10 | 25 | 6.8 | 63 |
| 15 | 61.5 | M 15.4 | m 23.1 | 7.7 | 2.0 | 6.5 | 0.6 | 14.1 | balance | 10 | 30 | 6.9 | 63 |
| 16 | 75 | L 13 | l 12 | 6.2 | 0.9 | 3.3 | 0.3 | 7.6 | balance | 7 | 13.6 | 7.1 | 57 |
| 17 | 62.2 | L 20.8 | h 17 | 10 | 1.6 | 5.1 | 0.5 | 9.8 | balance | 12 | 20.5 | 6.6 | 63 |
| 18 | 71.8 | H 11.2 | l 17 | 5.8 | 1.3 | 4.6 | 0.4 | 10.8 | balance | 7 | 20.5 | 7.7 | 61 |
| 19 | 67.7 | H 20.3 | h 12 | 10.6 | 1.1 | 3.6 | 0.3 | 6.9 | balance | 12 | 13.6 | 6.5 | 59 |
| 20 | 80 | M 20 | — | 10 | — | — | — | — | balance | 10 | — | 6.6 | 54 |
| 21 | aluminum bronze ingot | | | 10 | | 3.2 Fe-1 Ni- | | | balance | 10 | — | 7.5 | 98 |

TABLE 1-continued

| Sample No. | Raw Material Powder Mixing Ratio (% by weight) Cu | Cu—Al Powder 1) | Powder for Dispersion Phase 2) | Composition of Sintered Alloy (% by weight) Al | Cr | Mo | Si | Co | Cu | Al Content in Base Phase (% by weight) | Dispersion Phase Ration to Base Phase (part by weight) | Sintered Density (g/cm³) | Hardness (HRB) |
|---|---|---|---|---|---|---|---|---|---|---|---|---|---|
| | | | | | | | 0.05 Mn | | | | | | |

REMARKS: Composition of raw material powder (% by weight)
1) Cu—Al powder
H: Cu-52 Al
M: Cu-50 Al
L: Cu-48 Al
2) powder for dispersion phase
h: Co-9.5 Cr-30 Mo-2.7 Si
m: Co-8.5 Cr-28 Mo-2.4 Si
l: Co-7.5 Cr-27 Mo-2.1 Si

TABLE 2

| Sample No. | Aluminum Content in Base Phase (% by weight) | Dispersion Phase Content (% by weight) | Radial Crushing Strength (kg/mm²) | Abrasion Loss of Valve Seat (μm) |
|---|---|---|---|---|
| 1 | 2 | m 14.5 | 27.8 | 210 |
| 2 | 4 | m 14.5 | 29.5 | 110 |
| 3 | 6 | m 14.5 | 32.7 | 25 |
| 4 | 8 | m 14.5 | 35.9 | 10 |
| 5 | 10 | m 14.5 | 36.5 | 10 |
| 6 | 12 | m 14.5 | 34.0 | 13 |
| 7 | 14 | m 14.5 | 18.0 | 240 |
| 8 | 16 | m 14.5 | 8.5 | 300 |
| 9 | 10 | m 4.8 | 44.5 | 93 |
| 10 | 10 | m 7.4 | 42.3 | 72 |
| 11 | 10 | m 9.9 | 39.7 | 32 |
| 12 | 10 | m 12.3 | 38.8 | 11 |
| 5 | 10 | m 14.5 | 36.5 | 10 |
| 13 | 10 | m 16.7 | 34.4 | 8 |
| 14 | 10 | m 20 | 30.6 | 6 |
| 15 | 10 | m 23.1 | 26.5 | 6 |
| 16 | 7 | l 12 | 37.1 | 10 |
| 17 | 12 | h 17 | 34.2 | 9 |
| 18 | 7 | l 17 | 35.5 | 7 |
| 19 | 12 | h 12 | 36.9 | 11 |
| 20 | 10 | — | 37.6 | 130 |
| 21 | 10 | — | —*) | 144 |

REMARKS
Composition of raw material powder for dispersion phase is:
h, Co - 9.5 Cr - 30 Mo - 2.7 Si
m, Co - 8.5 Cr - 28 Mo - 2.4 Si
l, Co - 7.5 Cr - 27 Mo - 2.1 Si (% by weight)
*) Data of Radial crushing strength in sample 21 was not available because the sample 21 was deformed by pressing subjected to the sample for measurement.

TABLE 3

| Sample No. | Sintered Density (g/cm³) Particle Size (mesh) −100 | −200 | −350 | Radial Crushing Strength (kg/mm²) Particle Size (mesh) −100 | −200 | −350 | Abrasion Loss of Seat Valve (μm) Particle Size (mesh) −100 | −200 | −350 |
|---|---|---|---|---|---|---|---|---|---|
| 9 | 6.5 | 6.5 | 6.6 | 43.9 | 44.3 | 44.5 | 75 | 81 | 93 |
| 10 | 6.6 | 6.6 | 6.7 | 41.8 | 42.1 | 42.3 | 60 | 65 | 72 |
| 11 | 6.7 | 6.7 | 6.7 | 39.2 | 39.5 | 39.7 | 44 | 44 | 32 |
| 12 | 6.7 | 6.7 | 6.7 | 37.8 | 38.5 | 38.8 | 28 | 25 | 11 |
| 5 | 6.7 | 6.8 | 6.8 | 36.2 | 36.5 | 36.5 | 24 | 21 | 10 |
| 13 | 6.7 | 6.8 | 6.8 | 34.2 | 34.4 | 34.4 | 22 | 17 | 8 |
| 14 | 6.8 | 6.8 | 6.8 | 30.6 | 30.5 | 30.6 | 19 | 15 | 6 |
| 15 | 6.9 | 6.9 | 6.9 | 26.2 | 26.0 | 26.5 | 18 | 14 | 6 |
| 16 | 7.1 | 7.1 | 7.1 | 35.9 | 36.8 | 37.1 | 25 | 22 | 10 |
| 17 | 6.5 | 6.6 | 6.6 | 34.3 | 34.7 | 34.7 | 24 | 18 | 9 |
| 18 | 7.5 | 7.6 | 7.7 | 35.2 | 35.0 | 35.5 | 22 | 20 | 7 |
| 19 | 6.4 | 6.5 | 6.5 | 36.8 | 36.5 | 36.9 | 24 | 19 | 11 |
| 20 | | 6.6 | | | 37.6 | | | 130 | |

REMARKS: "−100" of the Particle Size indicates "equal to or less than that corresponding to 100 mesh".

What is claimed is:

1. A sintered alloy composition having a multi-phase structure, comprising: a first phase composed of aluminum and copper; and a second phase being dispersed in the first phase and composed of molybdenum, chromium, silicon and cobalt.

2. The sintered alloy composition of claim 1, wherein the first phase has a composition of about 7% to about 12% aluminum by weight and the balance copper.

3. The sintered alloy composition of claim 1, wherein the first phase has a composition of about 10% aluminum by weight and the balance copper.

4. The sintered alloy composition of claim 1, wherein the second phase is dispersed in the first phase at a content of about 12% to about 17% by weight with respect to the whole sintered alloy composition.

5. The sintered alloy composition of claim 1, wherein the second phase is dispersed in the first phase at a content of about 14.5% by weight with respect to the whole sintered alloy composition.

6. The sintered alloy composition of claim 2, wherein the second phase is dispersed in the first phase at a content of about 12% to about 17% by weight with respect to the whole sintered alloy composition.

7. The sintered alloy composition of claim 3, wherein the second phase is dispersed in the first phase at a content of about 14.5% by weight with respect to the whole sintered alloy composition.

8. The sintered alloy composition of claim 1, wherein the second phase has a composition of about 27% to about 30% molybdenum by weight, about 7.5% to about 9.5% chromium by weight, about 2.1% to about 2.7% silicon by weight and the balance cobalt.

9. The sintered alloy composition of claim 4, wherein the second phase has a composition of about 27% to about 30% molybdenum by weight, about 7.5% to about 9.5% of chromium by weight, about 2.1% to about 2.7% silicon by weight and the balance cobalt.

10. The sintered alloy composition of claim 6, wherein the second phase has a composition of about 27% to about 30% molybdenum by weight, about 7.5% to about 9.5% chromium by weight, about 2.1% to about 2.7% silicon by weight and the balance cobalt.

11. The sintered alloy composition of claim 7, wherein the second phase has a composition of about 28% molybdenum by weight, about 8.5% chromium by weight, about 2.4% silicon by weight and the balance cobalt.

12. A machine part made of the sintered alloy composition of claim 1.

13. A machine part made of the sintered alloy composition of claim 2.

14. A machine part made of the sintered alloy composition of claim 6.

15. A machine part made of the sintered alloy composition of claim 10.

16. A machine part made of the sintered alloy composition of claim 11.

17. A method of manufacturing the machine part of claim 12, the method comprising:

(a) mixing copper powder and alloy powder having a composition of about 48% to about 52% aluminum by weight and the balance copper so that the mixed powder has the same composition as that of the first phase;

(b) further mixing the mixed powder obtained in the Step (a) with alloy powder containing molybdenum, chromium, silicon and cobalt with the same composition as that of the second phase;

(c) compacting the mixed powder obtained in (b) by compression to form a compact for a machine part; and (d) sintering the compact obtained in (c).

18. A method of manufacturing the machine part of claim 13, the method comprising:

(a) mixing copper powder and alloy powder having a composition of about 48% to about 52% aluminum by weight and the balance copper so that the mixed powder has a composition of about 7% to about 12% of aluminum by weight and the balance copper;

(b) further mixing mixed powder obtained in the (a) with alloy powder containing molybdenum, chromium, silicon and cobalt with the same composition as that of the second phase;

(c) compacting the mixed powder obtained in (b) by compression to form a compact for a machine part; and (d) sintering the compact obtained in (c).

19. The method of claim 17, wherein the alloy powder containing molybdenum, chromium, silicon and cobalt in (b) has a particle size of not more than about 350 mesh.

20. The method of claim 18, wherein the alloy powder containing molybdenum, chromium, silicon and cobalt in Step (b) has a particle size of not more than about 350 mesh.

21. The method of claim 17, wherein the compact is sintered approximately at a temperature of 990° C. in (d).

22. The method of claim 18, wherein the compact is sintered approximately at a temperature of 990° C. in (d).

23. The method of claim 17, wherein the compact is sintered in a vacuum in (d).

24. The method of claim 17, further comprising a step of (e) oxidizing the sintered alloy compact obtained in (d).

25. The method of claim 24, wherein the compact is heated in air to be oxidized in (e).

26. A machine part manufactured by the method of claim 24.

27. A valve seat made of the sintered alloy of claim 1.

28. A valve seat made of the sintered alloy of claim 2.

* * * * *